United States Patent [19]

Yamada et al.

[11] Patent Number: 4,678,741

[45] Date of Patent: Jul. 7, 1987

[54] SILVER HALIDE PHOTOGRAPHIC MATERIALS

[75] Inventors: Sumito Yamada; Masaki Okazaki, both of Kanagawa, Japan

[73] Assignee: Fuji Photo Film Co., Ltd., Kanagawa, Japan

[21] Appl. No.: 851,020

[22] Filed: Apr. 14, 1986

Related U.S. Application Data

[63] Continuation of Ser. No. 630,149, Jul. 12, 1986, abandoned.

[30] Foreign Application Priority Data

Jul. 12, 1983 [JP] Japan ..... 58-126387

[51] Int. Cl.[4] ..... G03C 1/06; G03C 1/10

[52] U.S. Cl. ..... 430/445; 430/614; 430/448; 430/507; 430/591; 430/512; 430/517; 430/567; 430/502

[58] Field of Search ..... 430/445, 614, 448, 507, 430/591, 512, 517, 567, 502

[56] References Cited

U.S. PATENT DOCUMENTS 3,672,898 6/1972 Schwan et al. ..... 430/507
4,439,520 3/1984 Kofron et al. ..... 430/569

FOREIGN PATENT DOCUMENTS 84637 8/1983 European Pat. Off. .
129633 11/1978 Japan .

*Primary Examiner*—Won H. Louie
*Attorney, Agent, or Firm*—Sughrue, Mion, Zinn, Macpeak & Seas

[57] ABSTRACT

A silver halide photographic material having on a support at least one hydrophilic colloid layer and at least one silver halide emulsion layer containing tabular silver halide grains having a grain diameter of at least 5 times the thickness of the grains and at least one compound represented by general formula (I)

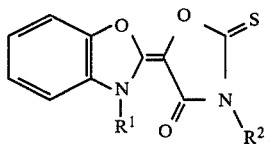

(I)

wherein $R^1$ represents a methyl group and $R^2$ represents an alkyl group, a substituted alkyl group, an aryl group, or a substituted aryl group.

23 Claims, No Drawings

SILVER HALIDE PHOTOGRAPHIC MATERIALS

This is a Continuation, of application Ser. No. 630,149, filed July 12, 1986, abandoned.

FIELD OF THE INVENTION

This invention relates to silver halide photographic materials and, more particularly to silver halide photographic materials containing tabular silver halide grains.

BACKGROUND OF THE INVENTION

Techniques for improving the covering power of silver halide in silver halide photographic materials have been variously investigated from the viewpoint of saving the amount of silver used for these photographic materials. A method of using tabular silver halide grains is known as one of these techniques.

The conventional method of using tabular silver halide grains may be excellent in improving the covering power of the silver halide but the method is not always satisfactory due to the disadvantage that the photographic materials using the tabular silver halide grains tend to be influenced by the development processing conditions used.

Hitherto, it is known to incorporate various additive such as stabilizers, antifoggants, etc., in ordinary silver halide photographic materials to minimize the development processing dependence of the photographic materials. These additives include for example, nitrobenzimidazoles, mercaptothiazoles, benzotriazoles, nitrobenzotriazoles, mercaptotetrazoles, etc., as described in U.S. Pat. Nos. 3,954,474 and 3,982,947; Japanese Patent Publication No. 28,660/'77, etc. However, with silver halide photographic materials containing tabular silver halide grains, these additives do not restrain the deviation of gradation of the photographic materials due to change in $Br^{\ominus}$ ion concentration in the developer or in high-temperature processing although the increase of fog in high-temperature processing may be restrained.

That is, high-temperature development, in particular high-temperature rapid processing using an automatic processor for efficiently performing the development of silver halide photographic materials is known in the art and such a process is employed to process various kinds of photographic materials with good effect. However, since photographic materials are processed at a high temperature in the process, the physical strength of the emulsion layers of the photographic materials must be increased to prevent the emulsion layers from becoming brittle by the pressure of rollers and belts of the automatic processor. Accordingly, measures must be taken to increase the physical strength of the emulsion layers of the photographic materials as the development progresses in a developer to keep the high strength of the emulsion layers during processing. For the purpose, a processing method which is performed with the addition of an aldehyde series hardening agent to a developer has been proposed. According to the method, the overall processing time is shortened by high-temperature processing and the purpose of rapid processing is attained to some extent. However, when the development process is performed using a developer containing, for example, an aldehyde, in particular an aliphatic dialdehyde, the formation of fog becomes severe. This tendency is increased as the temperature at which the developer is used increases and the developing time is longer. The formation of fog caused by such an aldehyde can be prevented to some extent by using a strong antifoggant such as benzotriazole or 1-phenyl-5-mercaptotetrazole as described in, for example, L. F. A. Mason; *Photographic Processing Chemistry,* page 40, Focal Press (1975) but, on the contrary, the progress of development is greatly restrained by the presence of such an aldehyde, whereby the sensitivity of silver halide emulsions is greatly reduced. However, in high temperature rapid processing (e.g., 28°-38° C., 25 sec.), the addition of such a strong antifoggant results in a problem in that the composition of the developer is considerably changed with the passage of time by aerial oxidation, etc., the change in the compositions of photographic materials, etc., which changes greatly the photographic properties.

Also, an attempt of adding alkylene oxides to ordinary silver halide photographic emulsions to minimize the development processing dependence of the photographic emulsions cannot practically be employed since the addition of alkylene oxides greatly reduces the sensitivity of the silver halide emulsions.

SUMMARY OF THE INVENTION

An object of this invention is, therefore, to provide a silver halide photographic material containing tabular silver halide grains showing less development processing dependence.

As the result of various investigations, it has now been discovered that the above-described object of this invention can be attained by the following silver halide photographic material of this invention.

That is, according to this invention, there is provided a silver halide photographic material comprising a support having thereon at least one hydrophilic colloid layer and at least one silver halide emulsion layer containing tabular silver halide grains having a grain diameter of at least 5 times the thickness thereof and a compound represented by general formula (I)

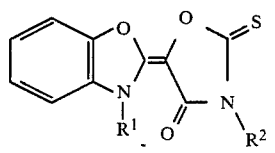

(I)

wherein $R^1$ represents a methyl group and $R^2$ represents an alkyl group, an aryl group, a substituted alkyl group, or a substituted aryl group.

DETAILED DESCRIPTION OF THE INVENTION

The compound shown by above-described general formula (I) is explained below in detail.

As described above, $R^1$ in general formula (I) represents a methyl group and $R^2$ in the general formula (I) represents an alkyl group, a substituted alkyl group, an aryl group, or a substituted aryl group.

The alkyl group shown by $R^2$ includes a methyl group, an ethyl group, a propyl group, a butyl group, an isobutyl group, a pentyl group, etc., although alkyl groups having more carbon atoms may be employed. The substituted alkyl group shown by $R^2$ includes a hydroxyalkyl group (e.g., a $\beta$-hydroxyethyl group, etc.), a fluorinated alkyl group, an acetoxyalkyl group (e.g., a $\beta$-acetoxyethyl group, a $\gamma$-acetoxypropyl group, etc.), an alkoxyalkyl group (e.g., a β-methoxyethyl group, a γ-methoxypropyl group, etc.), an alkoxycarbonylalkyl group (e.g., a β-methoxycarbonylethyl group, a γ-methoxycarbonylpropyl group, a δ-ethoxycarbonylbutyl group, etc.), a carboxyalkyl group (e.g., a carboxymethyl group, a β-carboxyethyl group, etc.), an allyl group, a cyanoalkyl group, a N,N-dialkylaminoalkyl group, a carbamoylalkyl group (e.g., a β-carbamoylethyl group, etc.), an aralkyl group (e.g., a benzyl group, a 2-phenylethyl group, etc.), an alkylthioalkyl group (e.g., a β-methylthioethyl group, etc.), a heterocyclic ring-substituted alkyl group (e.g., a furfuryl group, a tetrahydrofurfuryl group, etc.), etc. It is preferred that the alkyl group shown by $R^2$ has 1 to 10 carbon atoms and also the substituted alkyl group has 1 to 10 carbon atoms in the total thereof.

The aryl group shown by $R^2$ includes a phenyl group, etc., and as the substituents for the substituted aryl group shown by $R^2$, substituents for the substituted alkyl group described above are suitable.

Specific examples of the compound shown by general formula (I) are illustrated below.

I-1

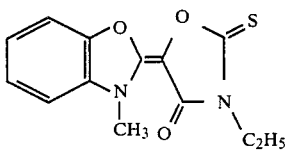

I-2

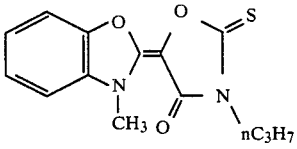

I-3

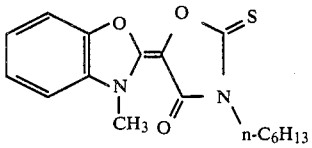

I-4

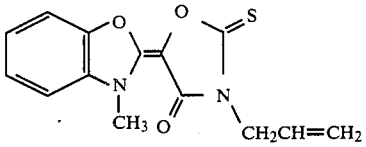

I-5

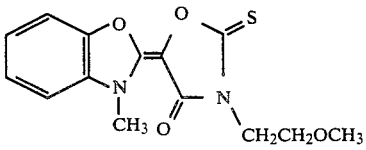

I-6

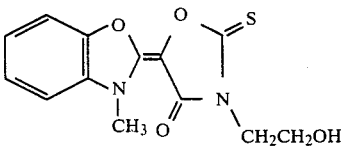

-continued

I-7

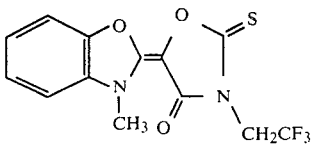

I-8

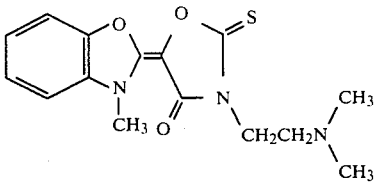

I-9

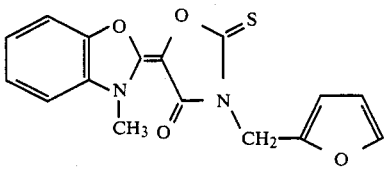

I-10

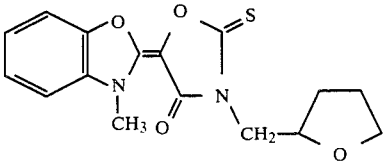

I-11

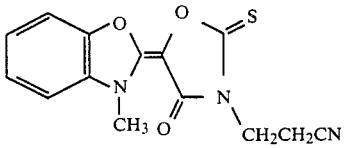

I-12

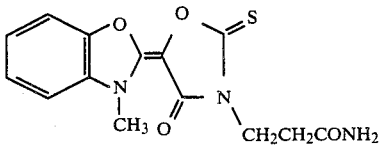

I-13

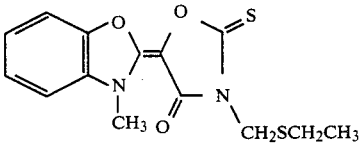

I-14

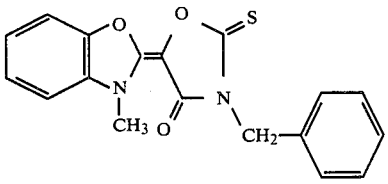

I-15

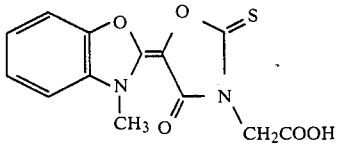

-continued

I-16

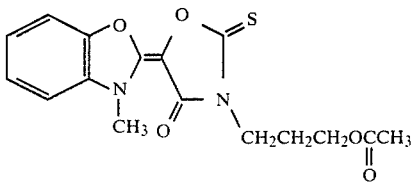

I-17

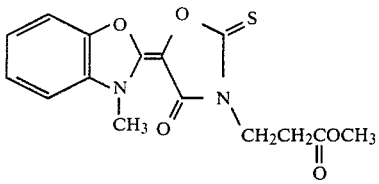

I-18

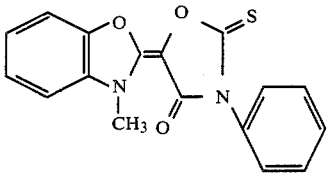

Some of the compounds shown by general formula (I) are known and they are readily available or can be easily prepared based on the descriptions of, for example, F. M. Hamer; *The Chemistry of Heterocyclic Compounds* (The Cyanine Dyes and Related Compounds), pages 58 and 536, John Wiley Sons (New York, London, 1964).

The amount of the compound shown by general formula (I) employed is preferably about 0.01 to about 10 m mole, more preferably about 0.05 to about 1.0 m mole per mole of the silver halide in the silver halide emulsion layer containing tabular silver halide grains.

The compound of general formula (I) can be incorporated in a silver halide emulsion layer using known methods. The compound may be added to the silver halide emulsion at any point in preparing the silver halide photographic material. For example, the compound may be added to the silver halide emulsion during the preparation of the silver halide emulsion (e.g., during chemical ripening, after chemical ripening of the emulsion, etc.) or directly before coating the silver halide emulsion.

*Research Disclosure,* January 1983, pages 20–58 (Item 22534) and West German Patent Application (OLS) No. 3,241,635 described general formulae as including general formula (I) in this invention but the effect of for minimizing the development processing dependence as in this invention cannot be obtained by the compounds of these general formulae having other groups than a methyl group as the group attached to the nitrogen atom of the benzoxazole nucleus of the compound shown by general formula (I) of this invention.

Also, when a silver halide is spectral-sensitized by the compound of this invention shown by general formula (I), the difference between the intrinsic absorption region of the silver halide and the spectral-sensitized region of the sensitized silver halide is less and hence in the case of using the compound of general (I), it is possible to sensitize the silver halide so that the change in sensitivity of the spectral-sensitized silver halide by the change in exposure wave length is same or almost same as the change in sensitivity of the unsensitized silver halide by the change in exposure wave length.

The tabular silver halide grains which are used in this invention are described below in detail.

The tabular silver halide grains in this invention have a diameter/thickness ratio of, preferably, at least 5, more preferably, 5 to 50, and most preferably 7 to 20.

The diameter of a silver halide grain means the diameter of a circle having an area the same as the projected area of the silver halide grain. The diameter of the tabular silver halide grains in this invention is 0.5 to 5.0 microns, preferably 1.0 to 4.0 microns.

In general, a tabular silver halide grain is a tabular grain having two substantially parallel faces and hence the "thickness" of the tabular silver halide grain in this invention is expressed by the distance between the two parallel faces of the tabular silver halide grain.

Silver bromide or silver iodobromide is preferred for the halogen composition for the tabular silver halide grains in this invention and in particular, silver iodobromide having 10 mole% or less silver iodide is preferred.

The method of production of the tabular silver halide grains is explained below.

Tabular silver halide grains can be produced by an appropriate combination of methods known in the art. The tabular silver halide emulsion is described, for example, in Cugnac and Chateau, "Evolution of the Morphology of Silver Bromide Crystals During Physical Ripening", *Science et Industries Photographiques,* Vol. 33, No. 2, pages 121–125 (1962); Duffin, *Photograhic Emulsion Chemistry,* pages 66–72, Focal Press, New York (1966); and A. P. H. Trivelli and W. F. Smith, *Phot. J., Vol.* 80, pages 285 (1940). The tabular silver halide emulsion can be easily prepared based on the methods described, for example, in Japanese Patent Applications (OPI) 127,921/83, 113,927/83 and 113,928/83. In more detail, tabular silver halide grains can be obtained by first forming a seed crystal containing more than 40% by weight tabular grains in an atmosphere of a comparatively low pBr value of lower than, for example 1.3 and then growing the seed crystal while keeping the pBr value at about the same value as above and also simultaneously adding a silver salt solution and a halide solution to the seed crystal.

In this case, it is preferred for the silver salt and the halogen solution to be added in such a manner that new crystal nuclei are not formed during growth of the silver grains. The size of the tabular silver halide grains can be controlled by a control of the temperature, the selection of the kind and amount of solvent, and a control of the addition rate of silver salt solution and halide solution used for the growth of the silver halide grains.

In producing tabular silver halide grains in this invention, the size of the silver halide grains, the form (a diameter/thickness ratio, etc.) of the silver halide grains, the size distribution of the silver halide grains, and the growth rate of the silver halide grains can be controlled by using, if desired, a silver halide solvent. It is preferred that the amount of the silver halide solvent be $10^{-3}$ to 1.0% by weight, particularly $10^{-2}$ to $10^{-1}$% by weight of the reaction solution.

For example, it is possible to increase the growth rate of the silver halide grains by forming monodispersed grain size distribution with the increase of the amount of the solvent. On the other hand, there is also a tendency of increasing the thickness of silver halide grains with the increase of the amount of the solvent.

Suitable silver halide solvents which are frequently used for the purpose are ammonia, thioethers, thiourea, etc. In regard to thioethers, the descriptions of U.S. Pat.

Nos. 3,271,157; 3,790,387; 3,574,628, etc., can be referred.

In producing tabular silver halide grains of this invention, it is preferred for increasing the growth rate of the silver halide grains to increase the addition rates, the addition amounts and the addition concentrations of the silver salt solution (e.g., an aqueous $AgNO_3$ solution) and the halide solution (e.g, an aqueous KBr solution).

These methods are described in, for example, U.K. Pat. No. 1,335,925; U.S. Pat. Nos. 3,672,900; 3,650,757; and 4,242,445; Japanese Patent Application (OPI) Nos. 142,329/'80; 158,124/'80, etc.

The tabular silver halide grains which are used in this invention can be, if desired, chemically sensitized. Suitable chemical sensitizing methods are a gold sensitizing method using a gold compound (e.g., U.S. Pat. Nos. 2,448,060; 3,320,069, etc.); a sensitizing method using a metal such as iridium, platinum, rhodium, palladium, etc. (e.g., U.S. Pat. Nos. 2,448,060; 2,566,245; 2,566,263, 1 etc.); a sulfur sensitizing method using a sulfur-containing compound (e.g., U.S. Pat. No. 2,222,264, etc.); a reduction sensitizing method using a tin salt, a polyamine, etc. (e.g., U.S. Pat. Nos. 2,487,850; 2,518,698; 2,521,925, etc.); and a combination of two or more of these methods.

In particular, from the viewpoint of silver conservation, it is preferred to employ the gold sensitizing method, the sulfur sensitizing method, or a combination of these methods for sensitizing the tabular silver halide grains of this invention.

It is preferred that in the layer containing the tabular silver halide grains of this invention, the tabular silver halide grains are present in an amount of at least about 40% by weight, in particular at least about 60% by weight of the total weight of the silver halide grains in the layer.

It is also preferred that the thickness of the layer containing the tabular silver halide grains be 0.3 to 5.0 microns, particularly 0.5 to 3.0 microns. Furthermore, it is preferred that the coating amount (on one side of a support) of the tabular silver halide grains be 0.5 to 6 $g/m^2$, particularly 1 to 4 $g/m^2$.

There are no particular restrictions as to the other constituents for the layer containing the tabular silver halide grains of this invention, such as binders, hardening agents, antifoggants, stabilizers for silver halides, surface active agents, spectral sensitizing dyes, dyes, ultraviolet absorbents, chemical sensitizers, etc., and they are described in, for example, *Research Disclosure,* Vol. 176, pages 22–28 (December, 1978).

The silver halide emulsion layer of the silver halide photographic material of this invention may contain conventional silver halide grains in addition to the tabular silver halide grains. These conventional silver halide grains can be prepared using the methods described in, for example, P. Glafkides, *Chimie et Physique Photographique,* Paul Montel Co., (1967); G. F. Duffin, *Photographic Emulsion Chemistry,* The Focal Press, (1966); V. L. Zelikman, et al, *Making and Coating Photographic Emulsion,* The Focal Press, (1964), etc. That is, these silver halide grains may be prepared by an acid method, a neutralization method, an ammonia method, etc., and also the reaction of a soluble silver salt and a soluble halide for producing the silver halide grains may be performed using a one side mixing method, a simultaneous mixing method, or a combination thereof.

Moreover, for producing conventional silver halide grains, a method of forming the silver halide grains in the presence of excess silver ions (so-called the reverse mixing method) can also be used. Also, as one embodiment of the simultaneous mixing method, a so-called controlled double jet method, that is, a method of maintaining a constant pAg in the liquid phase in which the silver halide is formed.

Suitable silver halides which can be used in this invention are silver bromide, silver iodobromide, silver iodochlorobromide, silver chlorobromide, silver chloride, etc.

In the step of forming the conventional silver halide grains or physical ripening of the silver halide grains, a cadmium salt, a zinc salt, a lead salt, a thallium salt, an iridium salt or a complex salt thereof, rhodium salt or a complex salt thereof, an iron salt or a complex salt thereof, etc., may be present. Also, if desired, such conventional silver halide grains may be chemically sensitized as in the case of the tabular silver halide grains.

The silver halide photographic emulsions which are used in this invention may contain various compounds for preventing the formation of fog and stabilizing the photographic properties thereof during the production, storage, or photographic processing of the photographic materials. Examples of these compounds are azoles such as benzthiazoles, nitroindazoles, nitrobenzimidazoles, chlorobenzimidazoles, bromobenzimidazoles, mercaptothiazoles, mercaptobenzthiazoles, mercaptobenzimidazoles, mercaptothiadiazoles, aminotriazoles, benztriazoles, nitrobenzotriazoles, mercaptotetrazoles (in particular, 1-phenyl-5-mercaptotetrazole, etc.), etc.; mercaptopyrimidines, mercaptotriazines; thioketo compounds such as oxazolinethiones, etc.; azaindenes such as triazaindenes, tetraazaindenes (in particular, 4-hydroxy-substituted (1,3,3a,7)-tetraazaindenes), pentaazaindenes, etc.; benzenethiosulfonic acid; benzenesulfinic acid; benzenesulfonic acid amide, etc., which are known as antifoggants or stabilizers. These compounds are practically described in, for example, U.S. Pat. Nos. 3,954,474, 3,982,947; Japanese Patent Publication No. 28,660/'77, etc.

The silver halide photographic emulsions which are used in this invention may be spectrally sensitized by methine dyes, etc. Useful sensitizing dyes for this invention are described in, for example, German Pat. No. 929,080; U.S. Pat. Nos. 2,493,748; 2,503,776; 2,519,001; 2,912,329; 3,656,959; 3,672,897; 3,694,217; 4,025,349; 4,046,572; U.K. Pat. No. 1,242,588; Japanese Patent Publication Nos. 14,030/'69, 24,844/'77, etc.

These sensitizing dyes may be used alone or as a combination thereof and a combination of sensitizing dyes is frequently used for the purpose of supersensitization. Typical examples thereof are described in U.S. Pat. Nos. 2,688,545; 2,977,229; 3,397,060; 3,522,052, 3,527,641; 3,617,293, 3,628,964; 3,666,480; 3,672,898; 3,679,428; 3,703,377; 3,814,609; 3,837,862; 4,026,707; U.K. Pat. Nos. 1,344,281; 1,507,803; Japanese Patent Publication Nos. 4936/'68; 12,375/'78; Japanese Patent Application (OPI) Nos. 110,618/'77; 109,925/'77, etc.

The silver halide emulsions which are used in this invention may further contain a dye which does not have a spectral sensitizing action by itself or a material which does not substantially absorb visible light and exhibits supersensitization together with the sensitizing dye. Examples of these materials are the aminostilbene compounds substituted with nitrogen-containing heterocyclic groups (e.g., those described in U.S. Pat. Nos. 2,933,390 and 3,635,721), aromatic organic acid-formaldehyde condensation products (e.g., those described in U.S. Pat. No. 3,743,510), cadmium salts, azaindene compounds, etc. The combinations described in U.S. Pat. Nos. 3,615,613, 3,615,641, 3,617,295 and 3,635,721 are particularly preferred.

There are no particular restrictions as to the other constituents of the silver halide emulsion layers not containing tabular silver halide grains of the silver halide photographic materials of this invention and various additives can be used, if desired, in these silver halide emulsion layers. For example, these are binders, surface active agents, dyes, ultraviolet absorbents, hardeners, coating aids, tackifiers, etc., described in *Research Disclosure,* Vol. 176, pages 22–28 (December, 1978).

Furthermore, the silver halide emulsion layers may contain styrene-butadiene rubber series polymers or ethyl acrylate series polymers, or emulsions thereof as a plasticizer.

It is preferred that the photographic material of this invention has a surface protective layer mainly composed of a synthetic polymer or natural polymer such as gelatin, a water-soluble polyvinyl compound or an acrylamide polymer as described in, for example, U.S. Pat. Nos. 3,142,568; 3,193,386; and 3,062,674.

The surface protective layer may contain a surface active agent, an antistatic agent, a matting agent, a lubricating agent, a hardening agent, a tackifier, etc., in addition to gelatin or other polymers as described above.

The photographic materials of this invention may further have, if desired, intrelayers, filter layers, antihalation layers, etc.

The silver halide photographic emulsion layers and other layers in the photographic materials of this invention are coated on a flexible support such as a synthetic resin film, a paper, a fibrous support, etc., or a solid support such as a glass plate, ceramic, a metal, etc. Examples of useful flexible support are films of semi-synthetic or synthetic polymers such as cellulose nitrate, cellulose acetate, cellulose acetate butyrate, polystyrene, polyvinyl chloride, polyethylene terephthalate, polycarbonate, etc., baryta-coated papers, papers coated or laminated with an $\alpha$-olefin polymer (e.g., polyethylene, polypropylene, an ethylene/butene copolymer, etc.), etc. The support for the photographic material of this invention may be colored with a dye or a pigment. The surface of the support may be subjected to a subbing treatment for improving the adhesion thereof with a photographic emulsion layer, etc. Furthermore, the surface of the support may be subjected to a corona discharge treatment, an ultraviolet treatment, a flame treatment, etc., before or after the subbing treatment.

There are no particular restrictions on the method of coating the layer containing the tabular silver halide grains, other silver halide emulsion layers, a surface protective layer, etc., on the support in this invention and, for example, the multilayer simultaneous coating method described in U.S. Pat. Nos. 2,761,418; 3,508,947; 2,761,791, etc., can be preferably used.

As to the stratum structure of the photographic material of the present invention, various structures are possible. For example, there are: (1) a stratum structure wherein a layer containing tabular silver halide grains in accordance with the present invention is provided on a support, a silver halide emulsion layer containing high speed silver halide grains of comparatively large particle size (0.5 to 3.0 $\mu$m) having a spherical form or having a diameter-thickness ratio of less than 5 is provided thereon, and a surface-protecting layer of gelatin or the like is further coated on the silver halide emulsion layer; (2) a stratum structure wherein a tabular silver halide grains-containing layer is provided on a support, a plurality of conventional silver halide emulsion layers are provided thereon, and a surface-protecting gelatin layer is further provided thereon; (3) a stratum structure wherein one conventional silver halide emulsion layer is provided on a support, a tabular silver halide grains-containing layer is provided thereon, a high-speed silver halide emulsion layer is provided thereon, and a surface-protecting gelatin layer is provided on the high-speed silver halide emulsion layer; (4) a stratum structure wherein a layer containing an ultraviolet ray absorbent or a dye, a tabular silver halide grains-containing layer, a conventional silver halide emulsion layer, and a surface-protecting gelatin layer are provided in this order on a support; and (5) a stratum structure wherein a layer containing tabular silver halide grains and an ultraviolet ray absorbent or a dye, a conventional silver halide emulsion layer, and a surface-protecting gelatin layer are provided in this order on a support.

In the above-described embodiments, the silver halide emulsion layer is not always a single layer but also can be a plurality of silver halide emulsion layers, each spectrally sensitized to different wave lengths. Also, these silver halide emulsion layers can be formed on both sides of a support.

The silver halide photographic material of this invention includes, radiographic elements (e.g., indirect X-ray photographic materials, direct X-ray photographic materials, etc.), lithographic photographic materials, black and white photographic papers, black and white negative films, etc., as well as color photographic materials such as color photographic negative films, color photographic reversal films, color photographic papers, etc. Among these photographic materials, the effect of this invention is remarkable in radiographic elements which is subjected to high-temperature rapid processing.

For processing the photographic materials of this invention, known processes and known processing solutions as described in, for example, *Research Disclosure,* Vol. 176, pages 28–30 (RD-17643) can be employed. The photographic processing may be a black and white photographic processing for forming silver images or color photographic processing for forming dye images. Processing temperatures are usually selected in the range of about 18° C. to about 50° C. but may be lower than 18° C. or higher than 50° C.

The developer which is used in black and white development in this invention can contain known developing agents. Examples of such developing agents are dihydroxybenzenes (e.g., hydroquinone), 3-pyrazolidones (e.g., 1-phenyl-3-pyrazolidone), aminophenols (e.g., N-methyl-p-aminophenol), etc., alone or as a combination thereof. The developer may further contain a known preservative, an alkali agent, a pH buffer, an antifoggant, etc., and further, if desired, a dissolution aid, a color toning agent, a development accelerator (e.g., a quaternary salt, hydrazine, benzyl alcohol, etc.), a surface active agent, a defoaming agent, a water softener, a hardening agent (e.g., glutaraldehyde), a tackifier, etc.

In a specific system for development processing of the photographic material of this invention, the photographic material contains a developing agent in the silver halide emulsion layer and the development thereof is performed by processing the photographic material with an aqueous alkali solution. For example, a hydrophobic developing agent may be incorporated in the silver halide emulsion layer of the photographic material using the method as described in, for example, *Research Disclosure,* Vol. 169 (RD-16028); U.S. Pat. No. 2,739,890; U.K. Pat. No. 813,253; and West German Pat. No. 1,547,763. Such a development processing may be combined with a silver salt stabilization processing using a thiocyanate.

Examples of development accelerators which can be used for accelerating the development of the photographic materials of this invention, which is incorporated in the developer are amine compounds as described in, for example, U.S. Pat. Nos. 2,196,037; 2,496,903; 2,515,147; 2,541,889; 2,482,546; 2,605,183; 1,086,681, etc.; imidazoles as described in U.S. Pat. Nos. 3,708,299 and 4,298,683; thioethers as described in, for example, U.S. Pat. Nos. 3,271,157; 3,574,628; 4,276,374; Japanese Patent Application (OPI) Nos. 12,360/'76 and 158,917/'79; thione compounds as described in, for example, Japanese Patent Application (OPI) Nos. 144,319/'78 and 82,408/'78.

As the fix solution for processing the photographic materials of this invention, a fix solution having a conventional composition can be used. The fix solution can contain an organic sulfur compound which is known to have an effect as a fixing agent in addition to a thiosulfate, a thiocyanate, etc. Furthermore, the fix solution may contain a water-soluble aluminum salt as a hardening agent.

According to this invention, by adding the compound shown by general formula (I) to the silver halide emulsion layer containing the above-described tabular silver halide grains, the change in photographic properties due to changes in development processing can be greatly reduced without reduction in sensitivity. This effect is particularly remarkable in high-temperature rapid processing (e.g., higher than 28° C., and within 30 sec.). More particularly, the effect is more marked in high-temperature rapid processing which is performed with the addition of an aldehyde series hardening agent (e.g., glutaraldehyde, etc.) to the developer.

The invention is illustrated in greater detail by the following examples. Unless otherwise indicated all parts, percents, ratios and the like are by weight.

EXAMPLE 1

A Photographic Material (1) was prepared as follows.

To one liter of water were added 30 g of gelatin, 10.3 g of potassium bromide, and 20 ml of an aqueous solution of 0.5% by weight thioether, ($HO(CH_2)_2S(CH_2)_2S(CH_2)_2OH$), in a vessel maintained at 70° C. and after adding simultaneously thereto Solution I and Solution II described in Table 1 below with stirring (at pAg of 9.1 and pH of 6.5) over a period of 15 sec., Solution III and Solution IV shown in Table 1 below were simultaneously added to the mixture over a period of 65 minutes by a double jet method.

Furthermore, during the addition of Solution III and Solution IV, Solution V shown in Table 1 was simultaneously added to the mixture over a period of 15 minutes. Thereafter, the resultant mixture was chemically sensitized with a chloroaurate and sodium thiosulfate.

TABLE 1

| | | Solution I | Solution II | Solution III | Solution IV | Solution V |
|---|---|---|---|---|---|---|
| $AgNO_3$ | (g) | 5.7 | — | 94.3 | — | — |
| $H_2O$ | (ml) | 33 | 16.7 | 567 | 567 | 100 |
| KBr | (g) | — | 4.23 | — | 69.6 | — |
| KI | (g) | — | — | — | — | 1.5 |
| 5 wt. % Aqueous Solution of $HO(CH_2)_2S(CH_2)_2$—$S(CH_2)_2OH$ | (ml) | — | 0.45 | — | 15.0 | — |

The tabular silver halide grains thus obtained had a mean diameter of 1.8 microns, a mean diameter/thickness ratio of 13, and a silver iodide content of 1.5 mole%.

Then, an antifoggant (4-hydroxy-6-methyl-1,3,3a,7-tetraazaindene) in an amount of $7\times10^{-3}$ mole/mole Ag, a coating aid (dodecylbenzenesulfonate) in an amount of providing 30 dyne/cm$^2$ of surface tension, and a tackifier (polypotassium p-vinylbenzenesulfonate) in an amount of providing 30 centipoises of viscosity were added to the silver halide grains to provide a coating liquid. The silver/gelatin weight ratio in the coating liquid was 0.80:1.

Then, a 10 wt.% gelatin aqueous solution containing gelatin, sodium polystyrenesulfonate, fine polymethyl methacrylate particles (mean particle size of 3.0 microns), saponin, and 2,4-dichloro-6-hydroxy-s-trazine was prepared as the coating liquid for surface protective layer.

Then, Photographic Material (1) was prepared by coating the coating liquid for a silver halide emulsion layer and the coating liquid for surface protective layer described above on a polyethylene terephthalate film support followed by drying. In this case, the silver coverage of the silver halide emulsion layer thus formed was 2.8 g/m$^2$ and the gelatin coverage of the surface protective layer was 1.3 g/m$^2$.

Also, by following the same procedure as above except that each of Compounds I-1, I-2, I-4, I-5, I-7, I-9, and I-10 in this invention and Comparison Compounds II-1, II-2, II-3, II-4, and II-5 shown below were employed in the coating liquid for silver halide emulsion layer, Photographic Materials (2) to (13) were prepared.

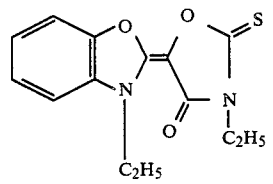

II-1

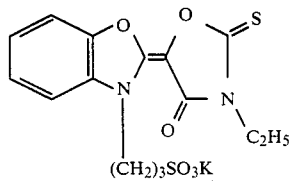

II-2

-continued

II-3

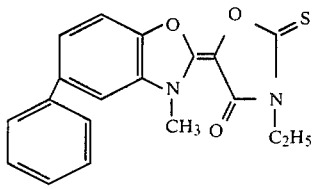

II-4

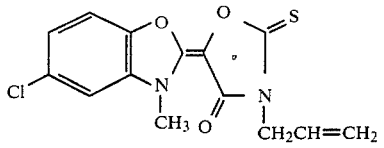

II-5

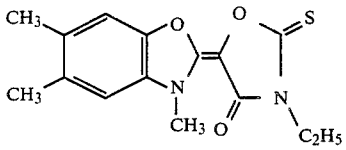

Each of the Photographic Materials (1) to (13) thus prepared was exposed to blue light of 360 to 480 nm having a peak of intensity at 414 nm and then subjected to Processing A and Processing B below.

Processing A: The photographic material was developed in a developer having the following composition at 31° C. for 25 sec., fixed in a fix solution having the composition shown below at 35° C. for 25 sec., and then washed with water followed by drying.

| | |
|---|---|
| Developer A: | |
| 1-Phenyl-3-pyrazolidone | 1.5 g |
| Hydroquinone | 30 g |
| 5-Nitroindazole | 0.25 g |
| Potassium Bromide | 3.7 g |
| Sodium Sulfite (anhydrous) | 50 g |
| Potassium Hydroxide | 20 g |
| Boric Acid | 10 g |
| Glutaraldehyde (25% aq. soln.) | 20 ml |
| Water to make | 1 liter |
| | (pH adjusted to 10.20) |
| Fix Solution: | |
| Ammonium Thiosulfate | 200.0 g |
| Sodium Sulfite (anhydrous) | 20.0 g |
| Boric Acid | 8.0 g |
| Ethylenediaminetetraacetic Acid Di-sodium Salt | 0.1 g |
| Aluminum Sulfate | 15.0 g |
| Sulfuric Acid | 2.0 g |
| Glacial Acetic Acid | 22.0 g |
| Water to make | 1 liter |
| | (pH adjusted to 4.20) |

Processing B: Same as Processing A except that the development in Developer A was performed at 37° C.

The sensitivities of the photographic materials thus processed were measured and the results obtained are shown in Table 2. The sensitivity is expressed as the logarithm of the reciprocal of the exposure amount necessary for obtaining optical density of fog +1.0.

TABLE 2

| Sample No. | Added Compound | Amount (mmol/mol-Ag) | Sensitivity Difference (A)* | Sensitivity Difference (B)* |
|---|---|---|---|---|
| (1) | None | — | 0 | 0.39 |
| (2) | I - 1 | 0.5 | +0.13 | 0.20 |

TABLE 2-continued

| Sample No. | Added Compound | Amount (mmol/mol-Ag) | Sensitivity Difference (A)* | Sensitivity Difference (B)* |
|---|---|---|---|---|
| (3) | I - 2 | 0.5 | +0.12 | 0.21 |
| (4) | I - 4 | 0.5 | +0.13 | 0.19 |
| (5) | I - 5 | 0.5 | +0.13 | 0.20 |
| (6) | I - 7 | 0.5 | +0.15 | 0.19 |
| (7) | I - 9 | 0.5 | +0.12 | 0.21 |
| (8) | I - 10 | 0.5 | +0.12 | 0.21 |
| (9) | II - 1 | 0.5 | +0.01 | 0.38 |
| (10) | II - 2 | 0.5 | −0.05 | 0.40 |
| (11) | II - 3 | 0.5 | −0.01 | 0.39 |
| (12) | II - 4 | 0.5 | +0.02 | 0.39 |
| (13) | II - 5 | 0.5 | +0.01 | 0.38 |

*(A) The sensitivity difference between each sample and Sample (1) in Processing A;

*(B) The sensitivity difference of each sample between Processing A and Processing B; each difference being shown by ΔLogE.

As is clear from the results shown in Table 2 above, it can be seen that when the tabular grain silver halide emulsion is combined with a compound of general formula (I) with a substituent other than a methyl group as $R^1$ or having a substituent at the benzene ring of the benzoxazole nucleus as in the case of the Comparison Samples give almost no increase of sensitivity or shows desensitization in spite of the fact that the compound has the same benzoxazole nucleus as the compound used in this invention. Also, the samples of this invention containing the compound of this invention shown by general formula (I) in the emulsion layer containing the tabular silver halide grains show greatly reduced deviation of sensitivity due to change in development temperature, while the comparison samples do not show such an effect.

EXAMPLE 2

Radiographic Material (14) was prepared in the following manner.

Spherical grains (mean particle size: 1.35 μm) of silver iodobromide (1.5 mole% silver iodide) were formed in the presence of ammonia by a double jet method and chemically sensitized with a chloroaurate and sodium thiosulfate. After the chemical sensitization was finished, antifoggants (1-phenyl-5-mercaptotetrazole and 4-hydroxy-6-methyl-1,3,3a,7-tetraazaindene) in an amount of $7\times10^{-3}$ mole/mole Ag, a coating aid (dodecylbenzenesulfonate) in an amount of providing 30 dyns/cm$^2$ of surface tension, and a tackifier (polypotassium p-vinylbenzenesulfonate) in an amount of providing 30 centipoises of viscosity were added to the silver halide emulsion to provide a coating liquid for a silver halide emulsion layer. In this case, the silver/gelatin weight ratio was 1.55:1.

Also, an aqueous 10 wt.% gelatin solution containing gelatin, sodium polystyrenesulfonate, fine polymethyl methacrylate particles (mean particle size of 3.0 microns), saponin, and 2,4-dichloro-6-hydroxy-s-triazine was prepared as a coating liquid for surface protective layer.

A polyethylene terephthalate film support of 180 microns in thickness having a subbing layer was then coated with the coating liquid for the tabular grain silver halide emulsion layer prepared in the same manner as described in Example 1, the above-described coating liquid for the silver halide emulsion layer, and then the coating liquid for surface protective layer by a simultaneous extrusion coating method to form three layers followed by drying to produce Photographic Material (14). In this case, the silver coverages of the tabular grain silver halide emulsion layer and the spherical grain silver halide emulsion layer were 2.4 g/m$^2$ and 1.0 g/m$^2$, respectively and the gelatin coverage of the surface protective layer was 1.3 g/m$^2$. Also, the spherical silver halide grains had a higher sensitivity than the tabular silver halide grains.

Then, by following the same procedure as above except that each of Compounds I-1, I-3, I-4, I-10, and I-11 of this invention and Comparison Compounds II-1, II-2, II-3, II-4, and II-5 was added to the tabular grain silver halide emulsion layer, Photographic Materials (15) to (24) were prepared.

Each of Photographic Materials (14) to (24) thus prepared was treated as follows:

Exposure: Same as in Example 1.

Processing A: Same as in Example 1.

Processing B: Same as in Example 1.

The sensitivities of the photographic materials thus processed were measured and the results obtained are shown in Table 3. The sensitivity is the same as defined in Table 2.

TABLE 3

| Sample No. | Added Compound | Amount* (mmol/mol-Ag) | Sensitivity Difference (A)** | Sensitivity Difference (B)** |
|---|---|---|---|---|
| (14) | None | — | 0 | 0.49 |
| (15) | I - 1 | 0.5 | +0.12 | 0.25 |
| (16) | I - 3 | 0.5 | +0.11 | 0.26 |
| (17) | I - 4 | 0.5 | +0.12 | 0.27 |
| (18) | I - 10 | 0.5 | +0.12 | 0.25 |
| (19) | I - 11 | 0.5 | +0.11 | 0.24 |
| (20) | II - 1 | 0.5 | 0 | 0.48 |
| (21) | II - 2 | 0.5 | −0.04 | 0.51 |
| (22) | II - 3 | 0.5 | −0.01 | 0.49 |
| (23) | II - 4 | 0.5 | 0 | 0.50 |
| (24) | II - 5 | 0.5 | +0.02 | 0.51 |

*Amount of the compound added to the tabular grain silver halide emulsion layer.
**(A): Sensitivity difference between each sample and Sample (13) in Processing A.
**(B): Sensitivity difference of each sample between Processing A and Processing B.

As shown by the results in Table 3, it can be seen that Photographic Material (14) having a double layer of the high-speed silver halide emulsion layer and the tabular grain silver halide emulsion layer is more influenced by the change in processing temperature than Photographic Material (1) in Example 1. However, in such a system, the effect of this invention is marked (Samples (15) to (19)) and the samples of this invention have higher sensitivity than Comparison Samples (20) to (24) and show less deviation in sensitivity due to change in processing temperature than the comparison samples.

While the invention has been described in detail and with reference to specific embodiments thereof, it will be apparent to one skilled in the art that various changes and modifications can be made therein without departing from the spirit and scope thereof.

What is claimed is:

1. A silver halide photographic material having on a support at least one hydrophilic colloid layer and at least one silver halide emulsion layer containing tabular silver halide grains having a grain diameter of at least 5 times the thickness of the grains and at least one compound represented by general formula (I)

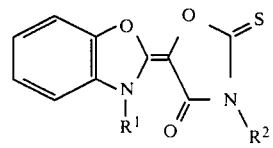

(I)

wherein $R^1$ represents a methyl group and $R^2$ represents an alkyl group, a substituted alkyl group, an aryl group, or a substituted aryl group.

2. The silver halide photographic material as claimed in claim 1, wherein the proportion of the compound represented by general formula (I) is 0.01 to 10 m mole per mole of the silver halide in the silver halide emulsion layer containing the tabular silver halide grains.

3. The silver halide photographic material as claimed in claim 1, wherein the tabular silver halide grains are silver bromide grains or silver iodobromide grains.

4. The silver halide photographic material as claimed in claim 1, wherein the silver halide emulsion layer containing the tabular silver halide grains further contains other silver halide grains.

5. The silver halide photographic material as claimed in claim 1, wherein the photographic material has on a support, in succession, the silver halide emulsion layer containing the tabular silver halide grains and the compound represented by general formula (I), a layer of a high-speed silver halide emulsion layer, and a surface protective layer.

6. The silver halide photographic material as claimed in claim 1, wherein the photographic material has on a support, in succession, the silver halide emulsion layer containing the tabular silver halide grains and the compound represented by general formula (I), a plurality of conventional silver halide emulsion layers, and a surface protective layer.

7. The silver halide photographic material as claimed in claim 1, wherein the photographic material has on a support, in succession, a conventional silver halide emulsion layer, the silver halide emulsion layer containing the tabular silver halide grains and the compound represented by general formula (I), a high-speed silver halide emulsion layer, and a surface protective layer.

8. The silver halide photographic material as claimed in claim 1, wherein the photographic material has on a support, in succession, a layer containing an ultraviolet absorbent or a dye, the silver halide emulsion layer containing the tabular silver halide grains and the compound represented by general formula (I), a conventional silver halide emulsion layer, and a surface protective layer.

9. The silver halide photographic material as claimed in claim 1, wherein the photographic material has on a support, in succession, the silver halide emulsion layer containing the tabular silver halide grains, the compound represented by general formula (I) and a ultraviolet absorbent or a dye, a conventional silver halide emulsion layer, and a surface protective layer.

10. The silver halide photographic material as claimed in claim 1, wherein the tabular silver halide grains have a diameter of 0.5 to 5. 0 microns.

11. The silver halide photographic material as claimed in claim 1, wherein the tabular silver halide grains have a diameter/thickness ratio of 5 to 50.

12. The silver halide photographic material as claimed in claim 1, wherein the tabular silver halide grains have a diameter/thickness ratio of 7 to 20.

13. The silver halide photographic material as claimed in claim 1, wherein the tabular silver halide grains are present in an amount of at least about 40% by weight based on the weight of the whole silver halide of the tabular silver halide grains-containing silver halide emulsion layer.

14. The silver halide photographic material as claimed in claim 1, wherein the tabular silver halide grains are present in an amount of at least about 60% by weight based on the weight of the whole silver halide of the tabular silver halide grains-containing silver halide emulsion layer.

15. The silver halide photographic material as claimed in claim 1, wherein the material has silver halide emulsion layers on both sides of the support.

16. A process for forming an image, comprising imagewise exposing and developing a silver halide photographic material having on support at least one hydrophilic colloid layer and at least one silver halide emulsion layer containing tabular silver halide grains having a grain diameter of at least five times the thickness of the grain and at least one compound represented by general formula (I)

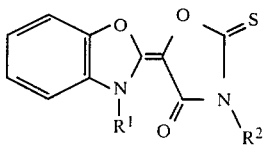

(I)

wherein $R^1$ represents a methyl group and $R^2$ represents an alkyl group, a substituted alkyl group, an aryl group, or a substituted aryl group.

17. A process as claimed in claim 16, wherein the proportions of the compound represented by general formula (I) is 0.01 to 10 m mol per mol of the silver halide in the silver halide emulsion layer containing the tabular silver halide grains.

18. A process as claimed in claim 16, wherein the tabular silver halide grains are silver bromide grains or silver iodobromide grains.

19. A process as claimed in claim 16, wherein the tabular silver halide grains have a diameter of 0.5 to 5.0 microns.

20. A process as claimed in claim 16, wherein the tabular silver halide grains have a diameter/thickness ratio of 5 to 50.

21. A process for forming an image as claimed in claim 16, wherein the tabular sivler halide grains are present in an amount of at least 40% by weight based on the weight of the whole silver hailde of the tabular silver halide grains-containing silver hailde emulsion layer.

22. A process as claimed in claim 16, wherein the tabular silver halide grains are present in an amount of at least about 60% by weight based on the weight of the whole silver halide of the tabular silver halide grains-containing silver halide emulsion layer.

23. A process as claimed in claim 16, wherein development is carried out at a temperature of 28° C. to about 50° C. and within 30 seconds and the developer contains an aldehyde hardening agent.

* * * * *